US010990037B2

(12) United States Patent
Shoshani et al.

(10) Patent No.: US 10,990,037 B2
(45) Date of Patent: Apr. 27, 2021

(54) DEVELOPERS

(71) Applicant: HEWLETT-PACKARD DEVELOPMENT COMPANY, L.P., Spring, TX (US)

(72) Inventors: Asaf Shoshani, Ness Ziona (IL); Lavi Cohen, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/604,356

(22) PCT Filed: Nov. 29, 2017

(86) PCT No.: PCT/US2017/063775
§ 371 (c)(1),
(2) Date: Oct. 10, 2019

(87) PCT Pub. No.: WO2019/108180
PCT Pub. Date: Jun. 6, 2019

(65) Prior Publication Data
US 2020/0285171 A1 Sep. 10, 2020

(51) Int. Cl.
*G03G 15/10* (2006.01)

(52) U.S. Cl.
CPC ... *G03G 15/104* (2013.01); *G03G 2215/0602* (2013.01)

(58) Field of Classification Search
CPC ..... G03G 15/104; G03G 15/11; G03G 2215/0602; G03G 2215/0658
See application file for complete search history.

(56) References Cited

U.S. PATENT DOCUMENTS

| | | | | |
|---|---|---|---|---|
| 4,286,039 | A | 8/1981 | Landa et al. | |
| 5,758,236 | A | 5/1998 | Teschendorf et al. | |
| 5,893,663 | A | 4/1999 | Facci et al. | |
| 6,292,646 | B1 * | 9/2001 | Maul | G03G 15/2025 399/325 |
| 7,522,865 | B2 | 4/2009 | Hasdai et al. | |
| 8,837,990 | B2 | 9/2014 | Nelson et al. | |
| 2010/0033064 | A1 * | 2/2010 | Tanaka | G01P 3/48 310/67 R |
| 2010/0296825 | A1 | 11/2010 | Kella et al. | |
| 2019/0033755 | A1 * | 1/2019 | Garcia | G03G 15/065 |

FOREIGN PATENT DOCUMENTS

| | | | |
|---|---|---|---|
| EP | 1024412 | A2 | 8/2000 |
| GB | 2235820 | | 3/1991 |
| JP | H10274885 | A | 10/1998 |
| WO | WO2017030580 | A1 | 2/2017 |
| WO | WO2017119905 | A1 | 7/2017 |

* cited by examiner

*Primary Examiner* — Sandra Brase
(74) *Attorney, Agent, or Firm* — Middleton Reutlinger

(57) ABSTRACT

A developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller.

14 Claims, 7 Drawing Sheets

100

400

500

700

DEVELOPERS

Electro-photography printing forms an image on a substrate by selectively charging or discharging a photoconductive member with an image to be printed. A colourant is applied to the photoconductive member and subsequently transferred to the substrate.

Liquid electro-photography (LEP) uses inks as the colourants, as opposed to, for example, a toner. A LEP printing device comprises a binary ink developer (BID) that applies the ink to a developer roller (DR) that, in turn, applies the ink to a Photo Imaging Plate (PIP) before transferring the ink to the substrate.

In between each duty cycle, LEP printing devices are cleaned with a view to maintaining a high image quality unadulterated by previous printing cycles. Ineffective cleaning can adversely affect print quality. Even though effective cleaning can be realised, other anomalies can give rise to print quality issues such as, for example, streaks caused by air bubbles in the ink on the DR.

BRIEF DESCRIPTION OF THE DRAWINGS

Various implementations are described, by way of example, referring to the accompanying drawings, in which.

DETAILED DESCRIPTION

Figure 1:
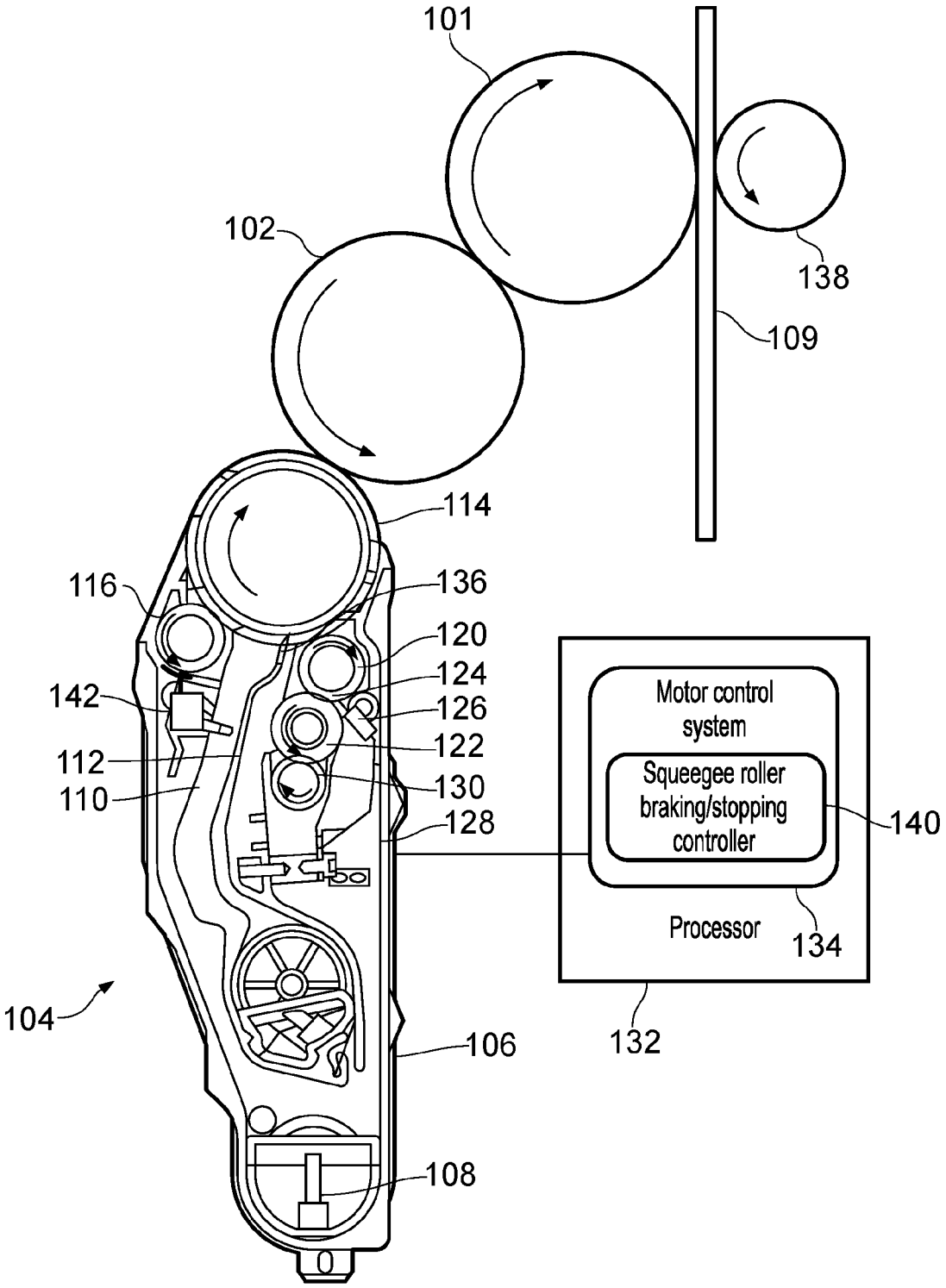
FIG. 1 shows a LEP device according to example implementations.

Referring to FIG. 1, there is shown a view of a liquid electro-photography printing device 100 according to an example implementation. The LEP printing device 100 can comprise an Intermediate Transfer member (ITM) or blanket drum 101, a photoconductive drum, that is, a Photo Imaging Plate (PIP) 102, and a developer, which can be a binary ink developer (BID) 104. Although implementations can use a drum as a transfer member, other transfer members such as, for example, a belt, can be used additionally or alternatively.

The BID 104 of the LEP printing device 100 comprises a housing 106. The housing 106 defines an ink tray 108 that collects ink that was not used in forming an image on a medium 109. The medium 109 is an example a substrate. The ink can be a combination of liquid and solid, such as 98% liquid and 2% solid in one example implementation. The liquid may be an oil or another type of liquid. The solid may be a pigment or another type of solid. During printing, ink is pumped from a tank (not shown) for use in printing and excess ink is collected in the ink tray 108 after printing from which it drains into the tank. Ink is an example of a printing liquid.

The BID 104 comprises first 110 and second 112 electrodes. The first and second electrodes 110 and 112 may be held at respective predetermined voltages such as, for example, a negative electrical potential, to influence ink movement to a developer roller (DR) 114. The state of the ink can be varied, that is, developed partially or fully. When the ink is in a state where it is more liquid than solid, the ink can migrate from the first and second electrodes 110 and 112 to coat the developer roller 114 of the BID 104. The developer roller 114 can be rotated clockwise as indicated by the associated arrow. The transfer of ink to the developer roller 114 is known as developing the ink or a development phase of printing.

The BID 104 includes a squeegee roller (SQ) 116 that rotates in the opposite direction to the developer roller 114. The squeegee roller 116 squeezes the ink that has been coated onto the developer roller 114 to influence ink characteristics such as, for example, ink viscosity. The squeegee roller 116 is operable to produce a uniform ink layer. Following squeezing, the ink can have a higher solid concentration. For instance, after squeezing by the squeegee roller 116, the ink coated on, or developed onto, the developer roller 114 may be 20% solid and 80% liquid.

After squeezing, the ink remaining on the developer roller 114 is selectively transferred to the PIP 102. The PIP 102 can rotate in the opposite direction to the developer roller 114. In operation, the PIP 102 will have been previously uniformly charged and, in response to an image to be printed or otherwise formed on the medium 109, selectively discharged by selective writing using laser light. The ink on the developer roller 114 is transferred to the PIP 102 in areas intended to form an image by the selective discharging. Thereafter, the PIP 102 makes contact with the ITM 101 that, in turn, makes contact with the medium 109 to transfer the ink to the medium 109. Therefore, a desired image is formed on the medium 109. The ITM 101 and PIP 102 rotate as indicated in FIG. 1 by the respective arrows. Ink that is not transferred from the developer roller 114 to the PIP 102 is referred to as excess ink.

The BID 104 can comprise a cleaner roller (CL) 120. The cleaner roller can rotate as indicated in FIG. 1. The cleaner roller 120 cleans the excess ink from the developer roller 114.

The BID 104 can further comprise a sponge roller 122. The sponge roller 122 can rotate in the same direction as the cleaner roller 120. The sponge roller 122 comprises a sponge bearing many open cells or pores. Example implementations can be produced in which the sponge roller 122 can comprise an open-cell material such as, for example, polyurethane foam. The sponge roller 122 can be resiliently compressible and can be compressed by one or more than one of the second electrode 112, the cleaner roller 120 and a squeezer roller 130 of the BID 104, taken jointly and severally in any or all permutations.

The sponge roller 122 can also cooperate with a wiper blade 124 to recover excess ink from the developer roller 114, that is, any excess ink remaining on the cleaner roller 120 that is not removed by the sponge roller 122 is scraped from the cleaner roller 120 onto the sponge roller 122 by the wiper blade 124. The wiper blade 124 is part of a wiper mechanism 126 of the BID 104. The wiper mechanism 126 comprises a wiper back wall 128 to direct recovered ink into the tray 108. Ink flowing between the second electrode 112 and the developer roller 114 to the sponge roller 122 is remixed, by the sponge roller 122 and the second electrode 112, with excess ink to return the excess ink to its former state.

The squeezer roller 130 recovers the excess ink that has been absorbed by the sponge roller 122 for reuse. Therefore, the excess ink released from the sponge roller 122 by the squeezer roller 130 returns to the ink tray 108 and drains into a tank (not shown). Example implementations can be realised in which the sponge roller 122 is also operable to disperse or otherwise break up solid parts of the excess ink. Prior to recovery, excess ink acts more like a solid than a liquid. The squeezer roller 130 releases the excess ink from the sponge roller 122 by compressing the sponge roller 122, that is, the squeezer roller 130 is urged against or otherwise resiliently compresses the sponge roller 122 to release the excess ink from the sponge roller 122. However, example implementations can be realised that do not use a squeezer roller 130.

Also shown in FIG. 1 is a processor or controller 132 for controlling the overall operation of the BID 104. The processor or controller 132 can be arranged to execute executable code 134 to control the operation of the BID 104. The executable code 134 can comprise instructions arranged, when executed by the processor 132, to control a number of aspects of the operation of the LEP printing device 100 such as, for example, operating one or more than one motor (not shown) associated with driving one or more than one of the above rollers, one or more voltages applied to the rollers and electrodes during BID operation such as, for example, one or more than one cycle of the LEP 100. A cycle can comprise one or more of a development cycle, a printing cycle and a cleaning cycle.

As well as the processor controlling the various motors that are used to rotate the various rollers of the BID 104, the processor can also control mechanisms for engaging and disengaging the BID 104.

During a printing cycle, the BID 104 performs several functions comprising developing ink, applying ink to the PIP and removing residual ink. Ink flows from the ink tank through channel 136, in the gap between the two electrodes 110 and 112, to the developer roller 114. The developer roller 114 applies the ink to the PIP 102. The ink is then transferred by the ITM 101 to the medium 109, with the assistance of an impression roller 138. After a printing cycle, the cleaner roller 120 removes excess ink from the developer roller 114.

The above operations can be performed under the control of the processor or controller 132 by, for example, processing the executable code or using specific hardware. Any such software or hardware, or combination of the two, can form a motor control system 134. The processor or controller 132 is arranged to drive motors (not shown) to control one, or both, of the speed and timing of rotation of the rollers. Additionally, or alternatively, the processor 132 can be arranged to control the voltages applied to the rollers and electrodes for electrostatically cleaning the rollers, for electrostatically cleaning the developer roller 114, as well as for ink development. The CL roller 120 voltage and the squeegee roller 116 voltage are set relative to the DR 114 voltage. The foregoing voltages are selected, applied and varied according to the ink to be deposited.

FIG. 1 shows a single BID 104. However, example implementations will use as many BIDs 104 as are appropriate to a colour system used by a printing device. For example, a four colour process, involving yellow, magenta, cyan and black, uses four BIDs. Similarly, a six colour process, such as, for example, Pantone's hexachrome system, would use six BIDs. Suitably, example implementations of printing devices can be realised that use a plurality of BIDs. One, or more than one, BID of the plurality of BIDs is operable according to example implementations described herein. Alternatively, all BIDs are operable according to example implementations described herein.

The motor control system 134 comprises a squeegee roller braking controller 140. The motor control system 134 is an example of a motor controller. The squeegee roller braking controller 140 is arranged to brake the squeegee roller 116. Braking the squeegee roller 116 comprises stopping the squeegee roller 116 from rotating. As discussed later with reference to FIG. 5, the squeegee roller braking controller 140 is responsive to an input or trigger. Stopping the squeegee roller 116 from rotating can be achieved in a number of possible ways comprising, for example, one, or both, of short-circuiting motor drive inputs of an H-bridge motor driver controller (not shown) associated with a motor driving a roller to be braked or actuating a brake 142 (shown in FIG. 2) associated with the squeegee roller 116.

Figure 2:
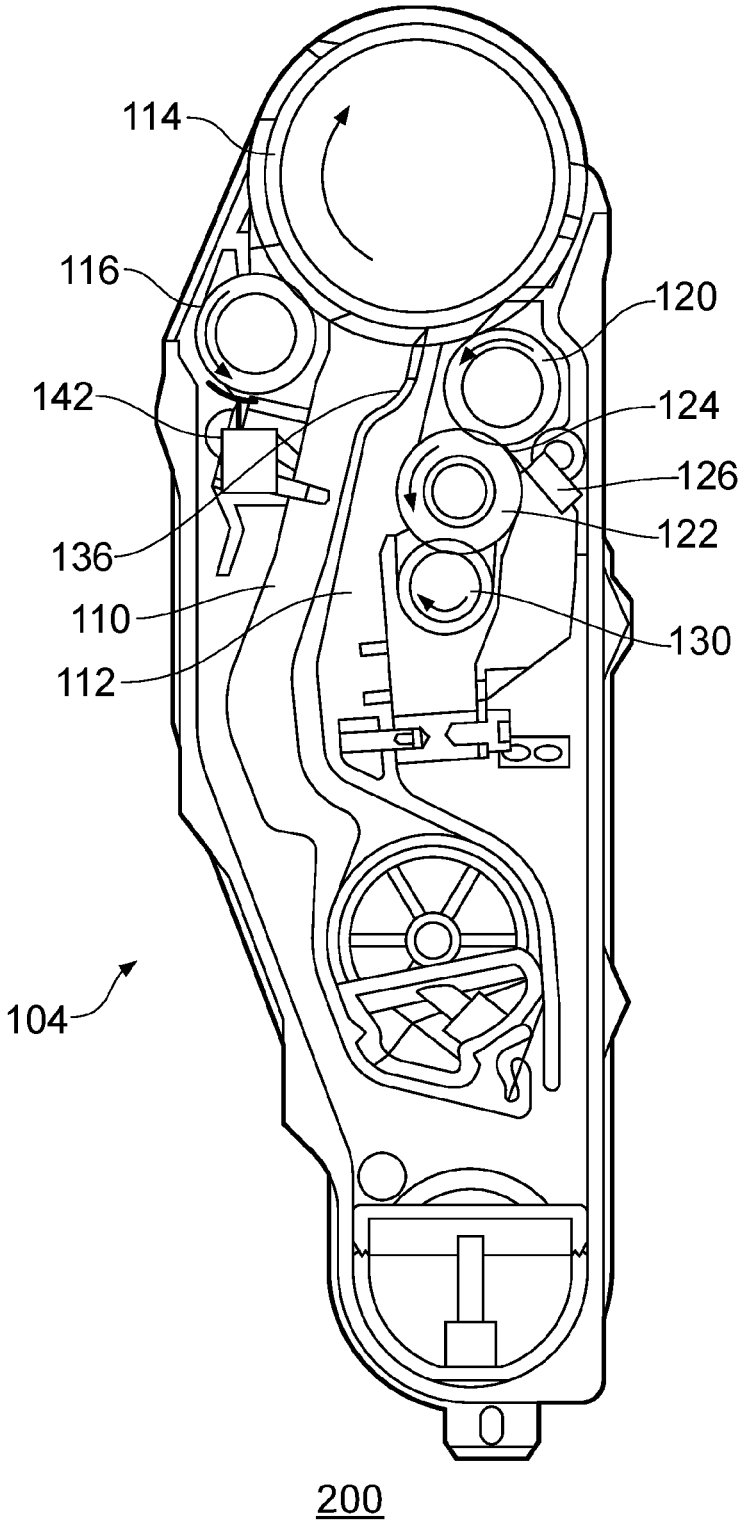
FIG. 2 depicts a LEP BID according to example implementations.

Referring to FIG. 2, there is shown a closer view 200 of the binary ink developer 104. Operations of the example implementations will be described with reference to four colour process printing, which will use four BIDs. Each of the four BIDs has respective control voltages. The BIDs are applied separately. Each BID has a duty cycle. A duty cycle can comprise a plurality of phases. The plurality of phases can comprise one of a preparation phase, a printing phase or a cleaning phase taken jointly or severally in any and all permutations. The respective preparation, printing and cleaning phases of one ink developer can run in parallel with respective preparation, printing and cleaning phases of another ink developer, but for simultaneous printing phases, which are not allowed. The duty cycle can comprise one of preparing the voltages for ink development in advance of the BID 104 engaging the PIP 102, printing the separation, that is, applying the ink to the PIP 102, or cleaning the BID 104 following separation taken jointly and severally in any and all permutations.

During printing, the BID 104 is engaged, that is, the BID 104 is positioned sufficiently proximate to the PIP 102, for printing to take place. Once printing has finished, the BID 104 is disengaged, that is, the BID 104 is moved to a distal position relative to the BID's proximal printing position.

Air bubbles in, or associated with, the ink may adhere to the DR 114, which creates a non-conductive non-uniform thin layer that, in turn, leads to the appearance of anomalies in an image, or that can adversely influence and even prevent ink flow into and from the electrodes. The air bubbles can create streaks in a printed image. Suitably, example implementations can be realised in which the motor control system 134 is arranged to stop the SQ roller 116 from rotating. Stopping the SQ roller 116 from rotating, relative to the developer roller 114, has been found to reduce or eliminate streaks, such as, for example, streaks or other anomalies associated with such air bubbles.

Additionally, example implementations can be arranged to provide a lubricant between the SQ roller 116 and the DR 114. Providing a lubricant between the SQ roller 116 and the DR 114 reduces the frictional coupling between the rollers 116 and 114. Additionally, or alternatively, example implementations can be realised in which the SQ roller 116 is arranged to be braked or otherwise stopped from rotating relative to the developer roller 114 with the result that the ink being applied to the DR 114 or the ink adhered to the DR 114 acts as a lubricant between the SQ roller 116 and the DR 114. Implementations can be realised in which such braking or stopping of the SQ roller 116 is arranged to occur during a predetermined phase of operation of the BID 104. For example, the squeegee roller 116 can be braked or otherwise stopped from rotating, relative to the developer roller 114, during a development phase of printing with the result that the ink being applied to the DR 114 or the ink adhered to the DR 114 acts as a lubricant between the SQ roller 116 and the DR 114

Figure 3:
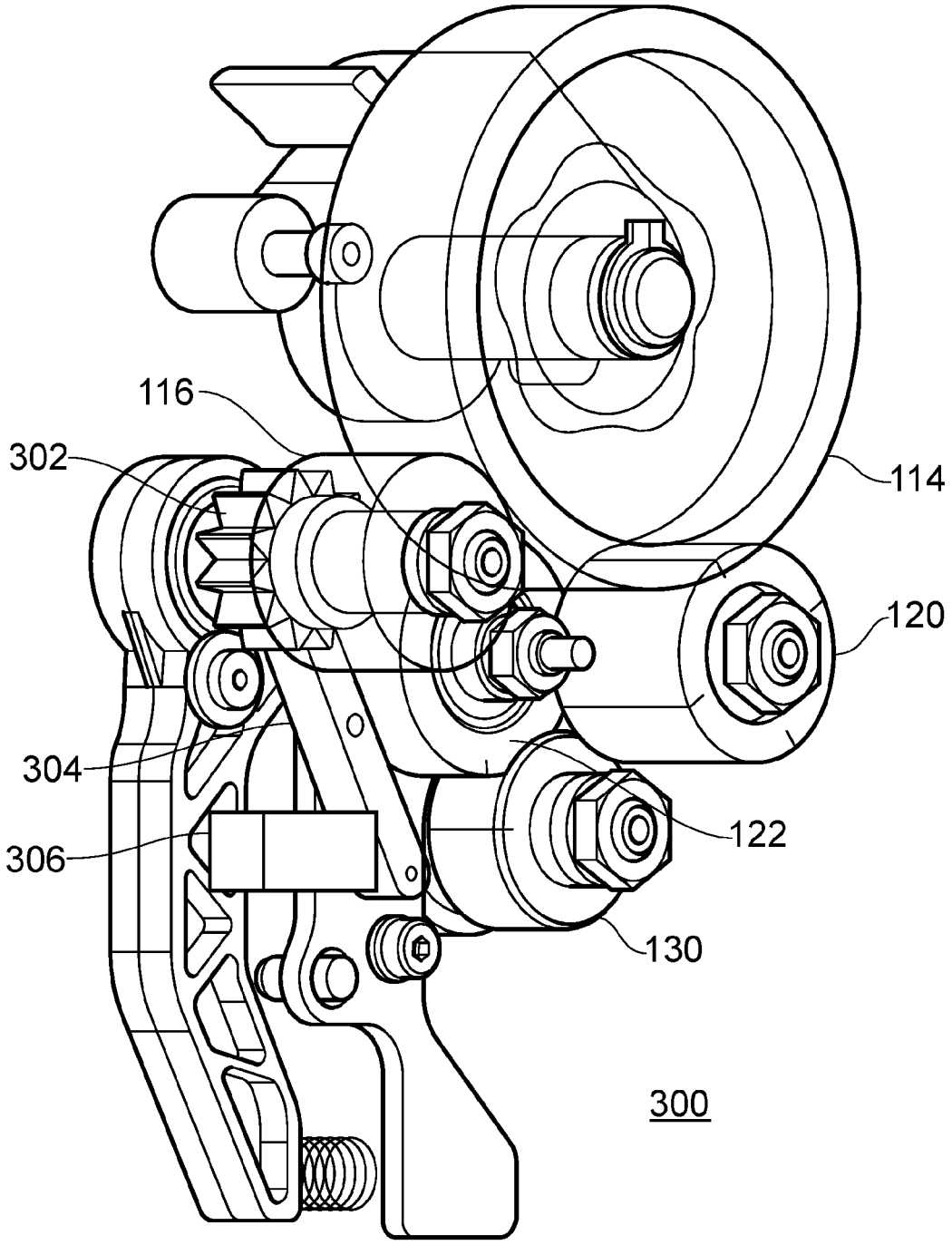
FIG. 3 illustrates BID rollers according to example implementations.

For example, referring to FIG. 3, there is shown a perspective view 300 of the rollers of the BID 104. The developer roller 114 and the squeegee roller 116 are shown in a transparent or faded form to reveal a ratchet 302. The ratchet 302 is coupled to the squeegee roller 116. The ratchet 302 is arranged to co-operate with a pawl 304 to stop the rotation of the squeegee roller 116 in response to actuating the pawl 304 via an actuator 306. The combination of the ratchet 302, pawl 304 and actuator 306 constitute or represent, in part, an implementation of a brake. The actuator 306 is responsive to a control signal. The control signal can be generated by, or in response to, the squeegee roller braking controller 140. The squeegee roller braking controller 140 can be responsive to a predetermined trigger. Example implementations can be realised in which the predetermined trigger is associated with the BID 104. For example, the predetermined trigger can be, or can be associated with, one or more than one signal associated with a roller of the BID 104. The one or more than one signal can be, for example, a voltage associated with a roller of the BID 104. For example, such a predetermined trigger can be associated with the cleaner roller 120, as will be described later, in the form of a voltage associated with the cleaner roller 120.

Example implementations herein can additionally comprise a clutch (not shown) associated with the squeegee roller 116. The clutch allows the squeegee roller motor to keep rotating even though the associated pawl 304 has engaged the ratchet 302 to stop the squeegee roller rotating. The clutch provides for slipping between a drive axle between the squeegee roller 116 and the squeegee roller motor at or above a predetermined torque.

It can be appreciated from FIG. 3 that the pawl 304 is shown in a braking or otherwise engaged position that stops the squeegee roller 116 from rotating.

Figure 4:
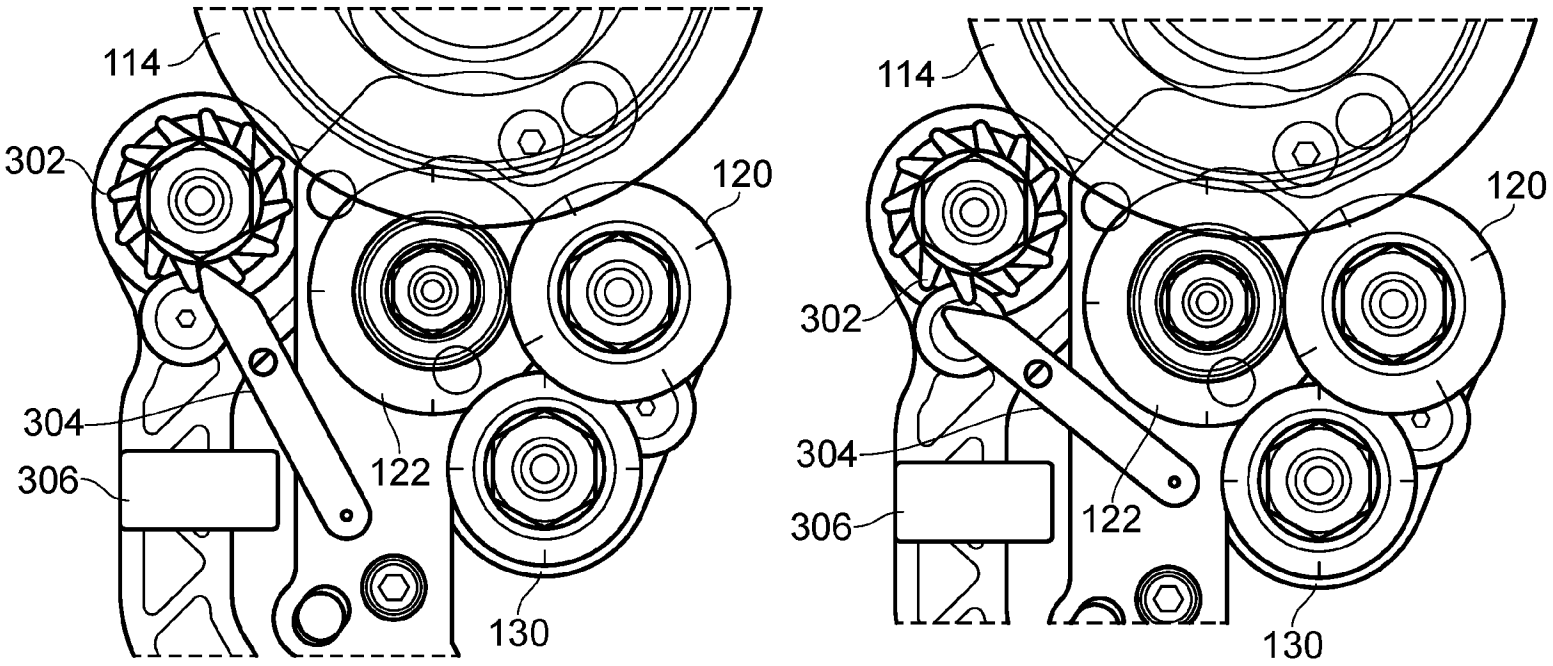
FIG. 4 shows BID rollers and a brake according to example implementations.

Referring to FIG. 4, there is shown a view 400 of the rollers of the BID together with the ratchet 302, pawl 304 and actuator 306. The left-hand image shows the squeegee roller 116 in a braked or otherwise stopped state due to the actuator 306 having actuated the pawl 304 to engage the ratchet 302. The right-hand image shows the squeegee roller 116 in a released or otherwise open state position due to the actuator 306 having actuated the pawl 304 to disengage from, or otherwise release, the ratchet 302.

Although the above implementations use a ratchet 302, pawl 304 and actuator 306 to stop the squeegee roller 116, implementations can, alternatively or additionally, be realised. Implementations can be realised in which the squeegee roller 116 is rotated by a motor (not shown) having respective motor control circuitry. The respective motor control circuitry can be realised in the form of, for example, an H-bridge. Shorting motor inputs of such an H-bridge will cause the motor to stop rotating. Therefore, such motor control circuitry is operable as, or can constitute an implementation of, a brake that stops the squeegee roller 116 from rotating relative to the developer roller 114.

Figure 5:
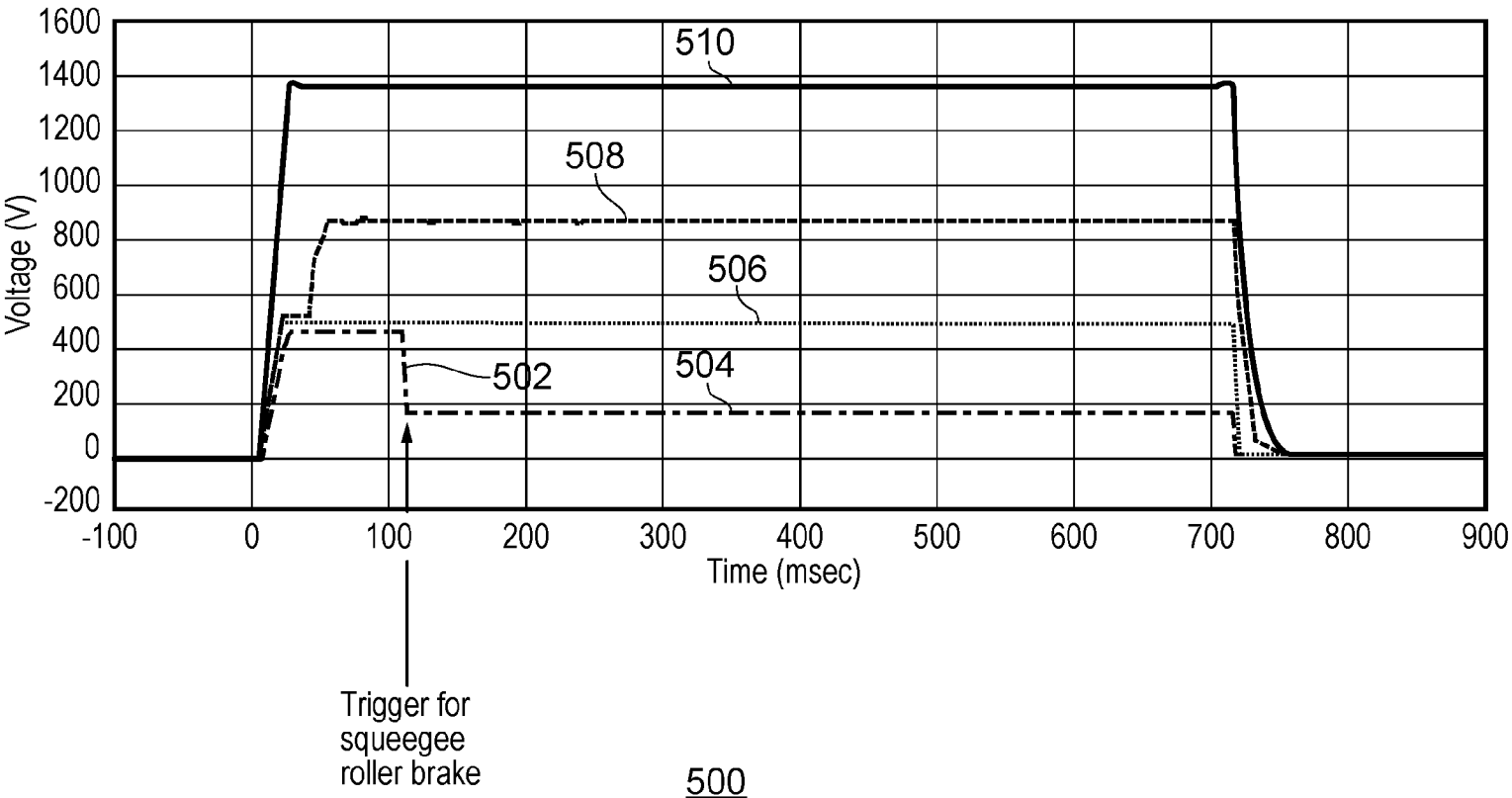
FIG. 5 shows a brake trigger event according to example implementations.

FIG. 5 shows a view 500 of a plurality of signals associated with operating a developer 104 according to an implementation. In the example implementation described, the plurality of signals is a plurality of voltages. A predetermined trigger 502 can be established to influence the braking operation; more particularly, the predetermined trigger can be established to control the timing of the braking operation, that is, a brake or stop signal, that stops the squeegee roller 116 from rotating. The predetermined trigger 502 can be associated with one or more than one of the plurality of signals. The predetermined trigger 502 can be associated with one or more than one characteristic of the one or more signals. In the example implementation depicted, it can be appreciated that the predetermined trigger 502 is associated with a respective roller voltage 504, which can be the cleaner roller voltage 504, but could alternatively, or additionally, be associated with a different roller voltage or signal. Example implementations can be produced in which the predetermined characteristic is a given signal level or signal transition. In the example implementation shown in FIG. 5, the predetermined characteristic is a negative going transition of the cleaner roller voltage 504, but could be a positive or negative going transition of the cleaner roller voltage or some other voltage.

The plurality of signals can comprise other signals, such as, for example, voltages, that are associated with operating a developer 104 according to implementations. In the implementation depicted, the plurality of signals can additionally, or alternatively, comprise one or more than one of a developer roller voltage 506, a squeegee roller voltage 508 or an electrode voltage 510 taken jointly and severally in any or all permutations.

Figure 6:
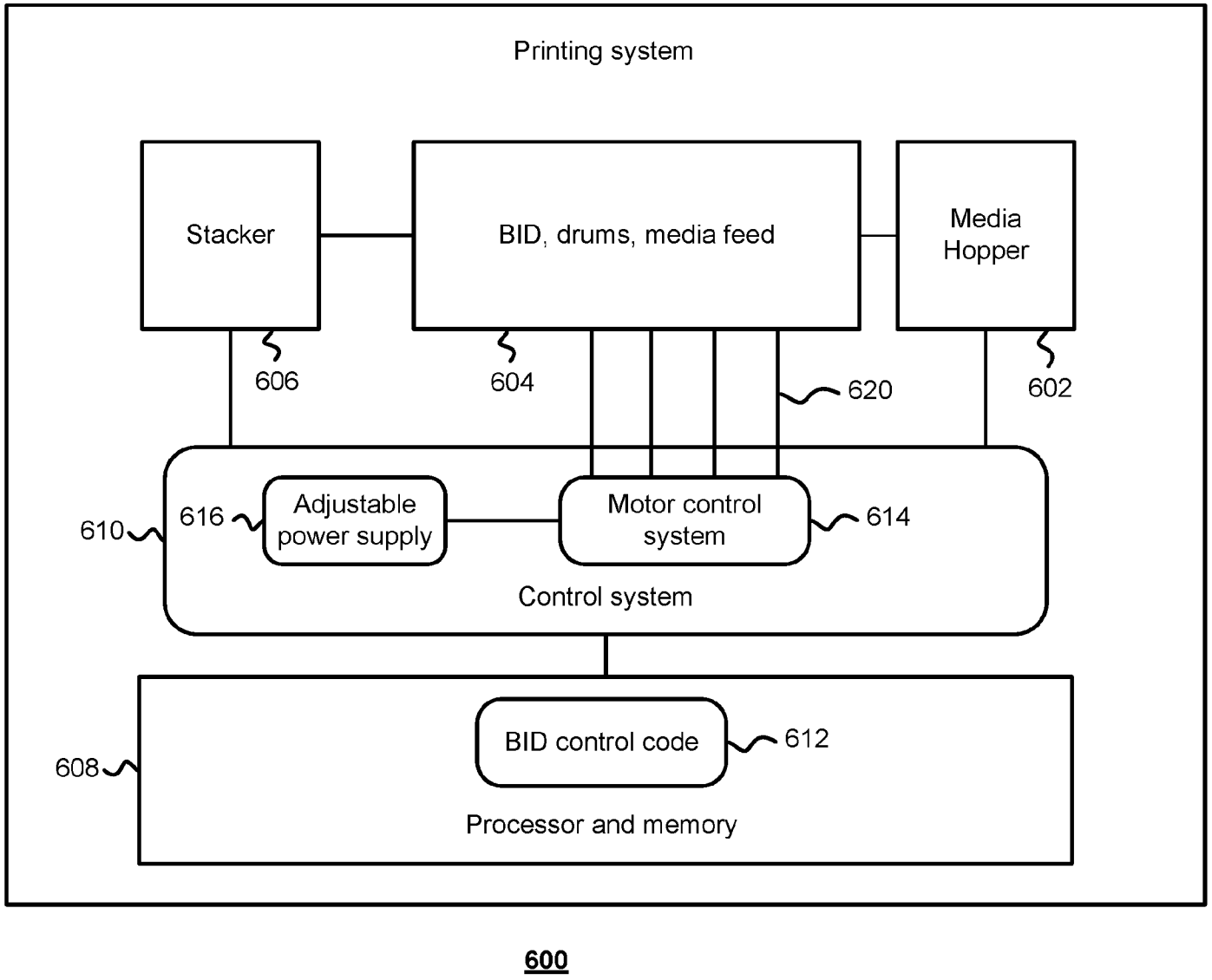
FIG. 6 illustrates a printing device according to example implementations.

FIG. 6 shows a view 600 of a printing device 100 according to any example implementation operable as described herein that uses the above described squeegee roller 116 braking to improve printing quality such as, for example, reducing streaks due to air bubbles in the ink or air bubbles otherwise associated with the DR 114. The printing device 600 can be, for example, an Indigo printer available from HP Inc. Company. A printer is an example of a printing device.

The printing device 600 can comprise a hopper 602 for holding print media. The print media is an example of a substrate. The above described medium 109 is an example of a substrate. Also shown a BID, drums or rollers and media feed mechanisms 604 for effecting printing and a stacker 606 for holding printed media. The BID, drums or rollers and media feed mechanism 604 can be realised as described herein with reference to, or as depicted in, the accompanying drawings taken jointly and severally in any or all permutations.

The printing device 600 also comprises a processor 608 configured to control the operations of the device. The processor 608 is arranged to control a control system 610 for influencing BID operations, comprising one or more than one of preparing for printing, printing per se or cleaning operations. The processor 608 is arranged to execute BID control code 612 for controlling the operation of the BID 104. Such control code can be an implementation of machine executable instructions as described above. The voltage control system 614 is configured to output the plurality of signals, such as, for example, the above described voltages, for influencing the operation of the BID such as, for example, one or more than one of the developer roller voltage, the first electrode voltage, the second electrode voltage, the squeegee roller voltage, the cleaner roller voltage or the PIP voltage or the predetermined trigger taken jointly and severally in any or all permutations. The voltage control system 614 can be configured to be responsive to a power supply such as, for example, an adjustable power supply 616. The plurality of voltages is supplied, via respective supply lines 620, to one or more than one BID 104. The processor 612 can be an implementation or realization of the above described processor or controller 132.

The control code 612, when executed, can orchestrate or otherwise control the operation of the printing device, including controlling the voltages 504 to 510 applied to the BID such as, for example, one or more than one of the brake signal, one or more than one signal associated with a preparation phase, one or more than one signal associated with a printing phase or one or more than one signal associated with a cleaning phase, taken jointly and severally in any or all permutations. The control code 612 can represent or be an implementation of the above described squeegee roller braking controller 140.

Figure 7:
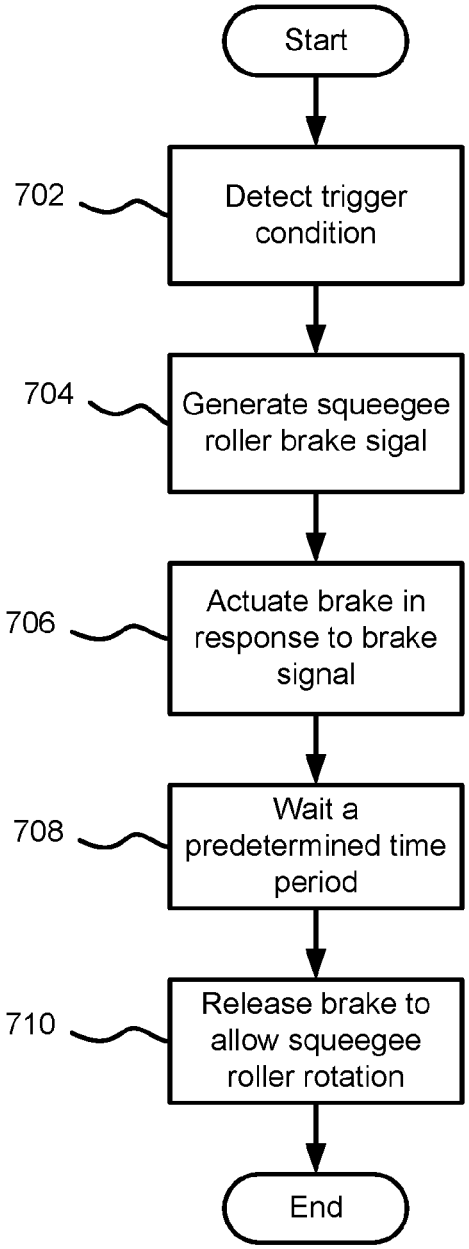
FIG. 7 depicts a flow chart of operations according to example implementations.

FIG. 7 shows a flow chart 700 of operations according to example implementations. At 702, the predetermined trigger 502 for braking the squeegee roller 116 is detected. In response, a squeegee roller brake or stop signal is generated at 704. The brake, such as the actuator 306, or motor controller, in response to the brake or stop signal stops the squeegee roller 116 from rotating at 706. Stopping the squeegee roller 116 from rotating can be achieved by, for example, moving the pawl 304 to engage the ratchet 302, or shorting the motor inputs of the motor controller. A predetermined period of time is waited at 708 before the brake is released, that is, before the actuator 306 releases the pawl 304 from the ratchet 302, or the motor inputs of the H-bridge are arranged, to allow the squeegee roller 116 to be rotated again at 710.

Example implementations of the present disclosure can be realised in the form of, or using, hardware, software or a combination of hardware and software. The hardware can comprise one, or both, of a processor and electronics. The foregoing, that is, the hardware, software or a combination of hardware and software, are implementations of circuitry. The circuitry can be configured or arranged to perform a respective purpose such as, for example, implementing any or all of the example implementations described in this specification. Any such software may be stored, in the form of executable code, on volatile or non-volatile storage such as, for example, a storage device like a ROM, whether erasable or rewritable or not, or in the form of memory such as, for example, RAM, memory chips, device or integrated circuits or machine-readable storage such as, for example, DVD, memory stick or solid-state medium. Storage devices and storage media are example implementations of machine-readable storage or non-transitory machine-readable storage that are suitable for storing a program or programs, that is, executable code, comprising instructions arranged, when executed, to realise example implementations described and claimed herein. Accordingly, example implementations provide machine executable code for realising a system, device, method or for orchestrating or controlling a method, developer, system or device operation as described in this specification or as claimed in this specification and machine-readable storage storing such code. Still further, such programs or code may be conveyed electronically via any medium such as a communication signal carried over a wired or wireless connection and example implementations suitably encompass the same.

Example implementations have been described with reference to a binary ink developer. Example implementations are not limited to a binary ink developer. Example implementations can be realised according to other developers in addition, or as alternatives, to binary ink developers.

Example implementations can provide a printer or printing device operable according to any of the methods described or shown in this specification.

Any or all of the methods described or claimed in this specification can be used to control a printing device comprising a binary ink developer. Therefore, example, implementations provide a controller to implement the methods described in this specification.

Example implementations can provide a printing device such as, for example, the device shown in or described with reference to FIG. 6. The printing device 600 can comprise a controller, circuitry or processor to control one, or more than one, ink developer 104 according to any method as described or claimed herein. Similarly, example implementations can provide a controller, circuitry or processor for controlling an ink developer or such a printing device; the controller comprising circuitry or a processor to orchestrate or implement any method as described or claimed herein. Furthermore, any such methods can be realised using machine executable code comprising instructions arranged, when executed by a processor, to control or implement any method described or claimed herein. Example implementations can provide non-transitory machine-readable storage storing such machine executable code.

Example implementations can be realised according to the following clauses:

Clause 1: A developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller.

Clause 2: The developer of clause 1, in which the squeegee roller being operable, via the brake, to stop rotating relative to the developer roller to influence the printing liquid on the developer roller comprises the squeegee roller being operable, via the brake, to stop rotating relative to the developer roller to reduce air within the printing liquid on the developer roller.

Clause 3: The developer of either of clauses 1 and 2, in which the brake comprises a pawl and ratchet; the pawl being arranged, when actuated, to stop the squeegee roller rotating.

Clause 4: The developer of any preceding clause, in which the brake is operable to stop the squeegee roller rotating relative to the developer roller in the presence of a lubricant between the squeegee roller and the developer roller.

Clause 5: The developer of any preceding clause, in which the brake is operable to stop the squeegee roller rotating relative to the developer roller in the presence of a printing liquid for forming the image; the printing liquid providing lubrication between the developer roller and the squeegee roller.

Clause 6: The developer of any preceding clause, in which the squeegee roller is mounted on a clutch arranged to slip at one of a predetermined torque or above a predetermined torque when the brake is actuated.

Clause 7: The developer of any preceding clause, wherein the brake comprises an electric motor for driving the squeegee roller; the motor being operable, responsive to drive circuitry, to stop rotating the squeegee roller.

Clause 8: The developer of clause 7, where the drive circuitry comprises one or more than one of a motor controller and an H-bridge for controlling the rotation of the squeegee roller.

Clause 9: The developer of clause 8, comprising circuitry arranged to short-circuit electric motor terminals of a squeegee motor via the H-bridge to stop the squeegee roller rotating.

Clause 10: The developer of clause 9, comprising circuitry to vary a squeegee roller motor control signal comprises circuitry to vary the squeegee roller voltage according to a predeterminable voltage profile.

Clause 11: The developer of any preceding clause, in which the brake is responsive to a trigger.

Clause 12: The developer of clause 11, in which the trigger is a roller voltage transition.

Clause 13: A controller for controlling a developer of any preceding clause; the controller comprising circuitry to output a brake signal to actuate the brake to stop rotation of the squeegee roller relative to the developer roller during depositing printing liquid onto the developer roller.

Clause 14: Machine-readable storage storing machine executable code arranged, when executed by a processor, to actuate the brake of a developer of any of clauses 1 to 13 to stop the squeegee roller rotating relative to a developer roller of the developer.

Clause 15: A controller for controlling a developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller; the controller comprising circuitry to output a brake signal to actuate the brake to stop rotation of the squeegee roller relative to the developer.

Clause 16: Machine-readable storage storing machine executable code arranged, when executed by one processor, to control a developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller; the machine executable code comprising instructions to output a brake signal to actuate the brake to stop rotation of the squeegee roller relative to the developer roller.

Clause 17: Machine-readable storage of clause 14, comprising code arranged, when executed by the processor, to stop the squeegee roller rotating relative to the developer roller in the presence of a lubricant between the squeegee roller and the developer roller.

The invention claimed is:

1. A developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller by reducing air within the printing liquid on the developer roller.

2. The developer of claim 1, in which the brake comprises a pawl and ratchet; the pawl being arranged, when actuated, to stop the squeegee roller rotating.

3. The developer of claim 1, in which the brake is operable to stop the squeegee roller rotating relative to the developer roller in the presence of a lubricant between the squeegee roller and the developer roller.

4. The developer of claim 1, in which the brake is operable to stop the squeegee roller rotating relative to the developer roller in the presence of an ink for forming the image; the printing liquid providing lubrication between the developer roller and the squeegee roller.

5. The developer of claim 1, in which the squeegee roller is mounted on a clutch arranged to slip at one of a predetermined torque or above a predetermined torque when the brake is actuated.

6. The developer of claim 1, wherein the brake comprises an electric motor for driving the squeegee roller; the motor being operable, responsive to drive circuitry, to stop rotating the squeegee roller.

7. The developer of claim 6, where the drive circuitry comprises one or more than one of a motor controller and an H-bridge for controlling the rotation of the squeegee roller.

8. The developer of claim 7, comprising circuitry arranged to short-circuit electric motor terminals of a squeegee motor via the H-bridge to stop the squeegee roller rotating.

9. The developer of claim 8, comprising circuitry to vary a squeegee roller motor control signal comprises circuitry to vary the squeegee roller voltage according to a predeterminable voltage profile.

10. The developer of claim 1, in which the brake is responsive to a trigger.

11. The developer of claim 10, in which the trigger is a roller voltage transition.

12. A controller for controlling a developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller by reducing air within the printing liquid on the developer roller; the controller comprising circuitry to output a brake signal to actuate the brake to stop rotation of the squeegee roller relative to the developer.

13. Machine-readable storage storing machine executable code arranged, when executed by a processor, to control a developer for a printer for printing to a substrate; the developer comprising a plurality of rollers operable to influence forming an image; the plurality of rollers comprising a developer roller for bearing printing liquid for forming the image and a squeegee roller for cooperating with the developer roller to influence the printing liquid on the developer roller, the squeegee roller being operable, via a brake, to stop rotating relative to the developer roller to influence the printing liquid on the developer roller by reducing air within the printing liquid on the developer roller; the machine executable code comprising instructions to output a brake signal to actuate the brake to stop rotation of the squeegee roller relative to the developer roller.

14. Machine-readable storage of claim 13, in which the machine executable code comprising instructions to output a brake signal to actuate the brake to stop rotation of the squeegee roller relative to the developer roller comprises instructions to stop the squeegee roller rotating relative to the developer roller in the presence of a lubricant between the squeegee roller and the developer roller.

* * * * *